US006401838B1

(12) United States Patent
Rezmer-Cooper

(10) Patent No.: US 6,401,838 B1
(45) Date of Patent: Jun. 11, 2002

(54) METHOD FOR DETECTING STUCK PIPE OR POOR HOLE CLEANING

(75) Inventor: Iain Rezmer-Cooper, Sugar Land, TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 09/711,734

(22) Filed: Nov. 13, 2000

(51) Int. Cl.[7] ..... E21B 47/09

(52) U.S. Cl. ..... 175/38; 175/40; 175/61; 175/62; 73/152.22; 73/152.56; 364/528.36; 367/82

(58) Field of Search ..... 175/38, 40, 61, 175/62, 65; 73/152.22, 152.56; 364/528.36; 367/82

(56) References Cited

U.S. PATENT DOCUMENTS 4,120,097 A 10/1978 Jeter
4,791,998 A 12/1988 Hempkins et al.
5,154,078 A 10/1992 Codazzi
5,275,040 A 1/1994 Codazzi
5,316,091 A 5/1994 Rasi et al.
5,448,911 A * 9/1995 Mason
5,454,436 A 10/1995 Jardine et al.

* cited by examiner

*Primary Examiner*—Roger Schoeppel
(74) *Attorney, Agent, or Firm*—John J. Ryberg; Steven L. Christian; JL (Jennie) Salazar

(57) ABSTRACT

The present invention provides a method of monitoring a well to detect and provide warning of pipe sticking. The method includes 1) monitoring the downhole annular fluid pressure of a drilling fluid being pumped through the drill string during drilling over predetermined intervals of time to obtain a series of pressure measurements, 2) monitoring the torque required to rotate the drill string during said periods to obtain a series of torque measurements, and 3) comparing the series of downhole annular fluid pressure measurements with the series of torque measurements so as to identify corresponding changes in both, and 4) raising an alarm when the magnitude of the changes passes predetermined alarm values.

17 Claims, 8 Drawing Sheets

METHOD FOR DETECTING STUCK PIPE OR POOR HOLE CLEANING

FIELD OF THE INVENTION

The present invention provides an improved method for detecting poor hole cleaning and stuck pipe during rotary drilling of a well. The present invention provides an improved method of preventing drilling delays, losses and hazards by early detection of conditions favorable for stuck pipe during rotary drilling of a well.

BACKGROUND OF THE RELATED ART

Wells are generally drilled to recover natural deposits of hydrocarbons and other desirable, naturally occurring, materials trapped in geological formations in the earth's crust. A slender well is drilled into the ground and directed to the targeted geological location from a drilling rig at the surface. In conventional "rotary drilling" operations, the drilling rig rotates a drillstring comprised of tubular joints of steel drill pipe connected together to turn a bottom hole assembly (BHA) and a drill bit that is connected to the lower end of the drillstring. During drilling operations, a drilling fluid, commonly referred to as drilling mud, is pumped and circulated down the interior of the drillpipe, through the BHA and the drill bit, and back to the surface in the annulus. It is also well known in the art to utilize a downhole mud-driven motor, located just above the drill bit, that converts hydraulic energy stored in the pressurized drilling mud into mechanical power to rotate the drill bit. The mud circulating pumps that pump the drilling mud and thereby power the mud-driven motor are sealably connected to the surface end of the drillstring through the standpipe and a flexible hose-like connection called a kelly.

When drilling has progressed as far as the drillstring can extend without an additional joint of drillpipe, the mud circulating pumps are deactivated and the end of the drillstring is set in holding slips that support the weight of the drillstring, the BHA and the drill bit. The kelly is then disconnected from the end of the drillstring, an additional joint of drillpipe is threaded and torqued onto the exposed, surface end of the drillstring, and the kelly is then reconnected to the top end of the newly connected joint of drillpipe. Once the connection is made, the mud pumps are reactivated to power the drill motor and drilling resumes.

To isolate porous geologic formations from the wellbore and to prevent collapse of the well, the well is generally cased with tubular steel pipe joints connected together to form a casing string. Casing is set in progressively smaller diameter sections as drilling progresses. Downhole conditions and the physical properties of drilled formations determine when a section of casing must be set in order to isolate exposed wellbore. During drilling operations, the drilling rig extends the drillstring through the casing and into the open wellbore and rotates the drill bit against rock and geologic formations lying in the trajectory of the drilling bit.

The fluid pressure in porous and permeable geologic formations penetrated by the wellbore is generally balanced by the hydrostatic pressure of the column of drilling mud in the well. Pressurized drilling mud is pumped into the surface end of the tubular drillstring by mud pumps that circulate mud down through the interior of the drillstring, through the BHA and drill bit and back up to the surface through the casing/drillstring annulus. Drilling mud is specially designed to not only balance formation pressure, but also to cool and lubricate the drillstring and drill bit, and to suspend and transport drill cuttings to the surface for removal. The process of using drilling mud to suspend and transport cuttings out of the wellbore is often called "hole cleaning."

Efficient hole cleaning greatly benefits the overall drilling process. A smooth and uniform flow of drilling mud promotes easy and cost-effective drilling. It is desirable for the cuttings to be uniformly dispersed and suspended in the flowing drilling mud as they are carried to the surface through the annulus. The flow rate, flow regime and viscosity of the drilling mud are key factors that determine the capacity of the drilling mud to suspend and transport drill cuttings to the surface. Slender, intermediate deviations (40°–60°) and horizontal wellbores are more subject to poor hole cleaning and stuck pipe than are larger, vertical wells because drill cuttings settling out of drilling mud tend to accumulate on the lower or downward side of the well. The unwanted accumulation of a stationary bed of drill cuttings interferes with the drilling process by resisting reciprocation and rotation of the drillstring. Poor hole cleaning results in high torque (resistance to rotation) and excessive drag (resistance to reciprocation) on the drill string, hole pack-off (resistance to drilling mud circulation) and, ultimately, stuck pipe. These conditions may cause well control problems, delays in drilling and poor drilling efficiency, adversely impacting the well economics and possibly resulting in the equipment loss or damage or even a loss of the wellbore.

A method has been devised for early detection of poor hole cleaning and stuck pipe using measured wellbore data. U.S. Pat. No. 5,454,436, issued to Jardine et al., describes a method of diagnosing and warning of pipe sticking during drilling operations and is incorporated herein by reference. The Jardine method mathematically analyzes the standpipe pressure (SPP) trace and the surface torque trace comprising a series of standpipe drilling mud pressures and surface torque measurements over the same time period, respectively. The input SPP trace and surface torque trace can be seen in FIGS. 1(A) and 1(B), respectively. Jardine's method determines the SPP skew of the SPP trace and the normalized standard deviation of the surface torque trace as shown in FIGS. 2(A) and 2(B), respectively. This attenuates and enables correlation of increases in the SPP and surface drillstring torque that are characteristic signatures of accumulated drill cuttings obstructing mud flow and packing off around the drill string. Jardine's method then determines the product of the SPP skew and the normalized standard deviation of the drill string torque trace to further attenuate the data to indicate events causing simultaneous spikes in the SPP skew and the surface torque normalized standard deviation as shown in FIG. 3(A). Finally, Jardine's method integrates the product of the SPP skew and the normalized standard deviation of the surface torque to produce the diagnostic shown in FIG. 3(B). The integrated value is a more reliable diagnostic than the product because the skew should oscillate between positive and negative values for normal drilling conditions, in other words, pressure fluctuations will be both positive and negative, and hence the integral should be close to zero. However, the integrated value will exhibit an increasing positive trend in the presence of positive pressure fluctuations indicative of poor hole cleaning or stuck pipe. Trend analysis or a simple thresholding technique can then be used to identify when this positive trend occurs.

The method disclosed by Jardine is, however, hindered by extraneous influences (besides poor hole cleaning) that contribute to the SPP trace, and therefore interfere with detection of poor hole cleaning and retard the accuracy of the wellbore diagnosis.

What is needed is a method of detecting poor hole cleaning or conditions favorable for the occurrence of stuck pipe that is not hindered by extraneous influences. What is needed is a method of detecting poor hole cleaning or conditions favorable for the occurrence of stuck pipe using data that is already generally available on drilling rigs, or with reliable and inexpensive additional downhole equipment. What is needed is a method of raising an alarm at the onset of poor hole cleaning or stuck pipe to alert persons operating the drilling rig to take timely remedial measures.

SUMMARY OF THE INVENTION

The present invention provides a method for early detection of poor hole cleaning or conditions favorable for the onset of stuck pipe during rotary drilling. The method provides early detection by inventive analysis and use of drill string torque data and downhole annular fluid pressure data, preferably on a real-time or near real-time basis. The annular fluid pressure is continuously measured downhole at the BHA (and possibly other depths) and communicated to the surface using telemetry, and is correlated with either surface or downhole torque measurements to attenuate certain signature responses. The method enables drilling rig operators to observe and recognize attenuated signature responses in downhole annular fluid pressure and surface or downhole torque data that arise from poor hole cleaning or stuck pipe in time to take preventive and remedial measures. The method uses generally available data to prevent the unwanted delays, hazards and losses that result from poor hole cleaning and stuck pipe.

Downhole annular fluid pressure is typically measured by the bottom hole assembly (BHA) and communicated to the surface during periods of active mud circulation. At the surface, the measured downhole annular fluid pressure trace is analyzed along with a simultaneously measured trace of the surface torque applied to rotate the drillstring. This correlation, enabled by mathematical manipulation of the data, enables the drilling rig operator to detect recognizable responses characteristic of poor hole cleaning and stuck pipe.

The downhole pressure trace commonly available to facilitate use of the improved method is measured at the BHA and communicated to the surface using telemetry, preferably mud-pulse telemetry. The telemetry data capacity of the drilling mud may allow additional downhole devices to transmit additional data to the surface. Optionally, the method may utilize additional downhole pressure traces or other data measured at instruments and sensors strategically placed along intervals of interest in the drillstring. The method may use correlation of one "local" annular fluid pressure trace to others measured at the BHA or other depths to diagnose the exact location and nature of poor hole cleaning or stuck pipe.

Optionally, the method may comprise correlating measured downhole drill string torque with the measured downhole annular fluid pressure trace(s).

DESCRIPTION OF DRAWINGS

So that the features and advantages of the present invention can be understood in detail, a more particular description of the invention, briefly summarized above, may be had by reference to the embodiments thereof which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

The present invention provides a method for monitoring and detecting poor hole cleaning or conditions favorable for the occurrence of stuck pipe during rotary drilling. The method provides for recurrent mathematical analysis of data to determine when poor hole cleaning or stuck pipe is likely to occur, preferably with the analysis being performed on an ongoing basis. The present invention may be integrated with visual, audible or other alarm systems to alert drilling rig operators of poor hole cleaning or stuck pipe so that timely remedial action can be taken to prevent hazards and delays and to decrease drilling costs.

The present invention utilizes a telemetry communication system. A mud pulse telemetry communication system is presently preferred for reliably communicating data from the BHA to the surface and has gained widespread acceptance in the industry. Mud pulse telemetry systems use no cables or wires for carrying downhole data to the surface, but instead it uses a series of decipherable pressure pulses that are transmitted to the surface through flowing, pressurized drilling fluid. One such system is described in U.S. Pat. No. 4,120,097, which is incorporated by reference. Mud pulse telemetry systems provide the drilling rig access to almost continuous real time data, including annular fluid pressure and drill string torque. Other telemetry systems, such as electromagnetic systems or EMAG telemetry, may also be used to advantage with the present invention.

The present invention provides a method of analyzing continuous real time annular fluid pressure and drill string torque data to detect poor hole cleaning and stuck pipe.

Figure 1A:
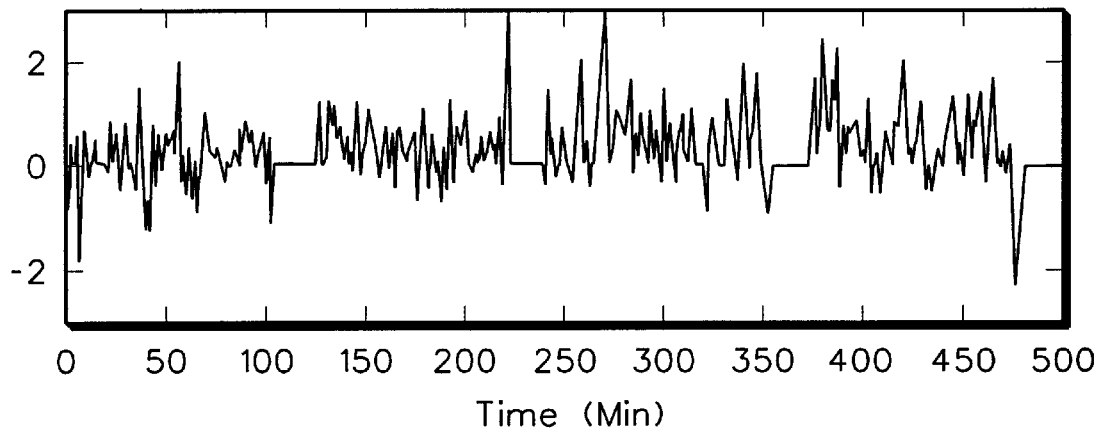
FIG. 1A (PRIOR ART)
FIGS. 1(A and B) are graphs of the measured standpipe pressure trace and drillstring surface torque trace, respectively, during an interval of time of erratic well behavior.
Figure 1B:
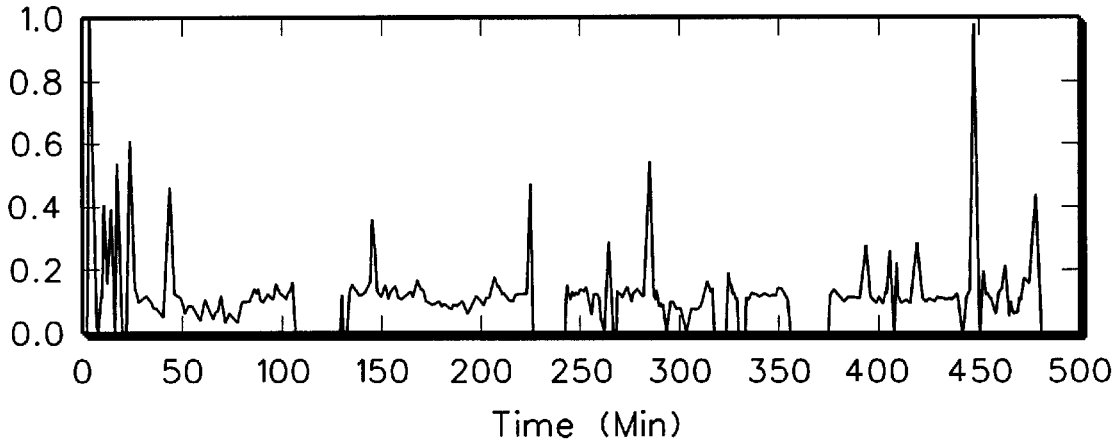
FIG. 1B (PRIOR ART)
Figure 2A:
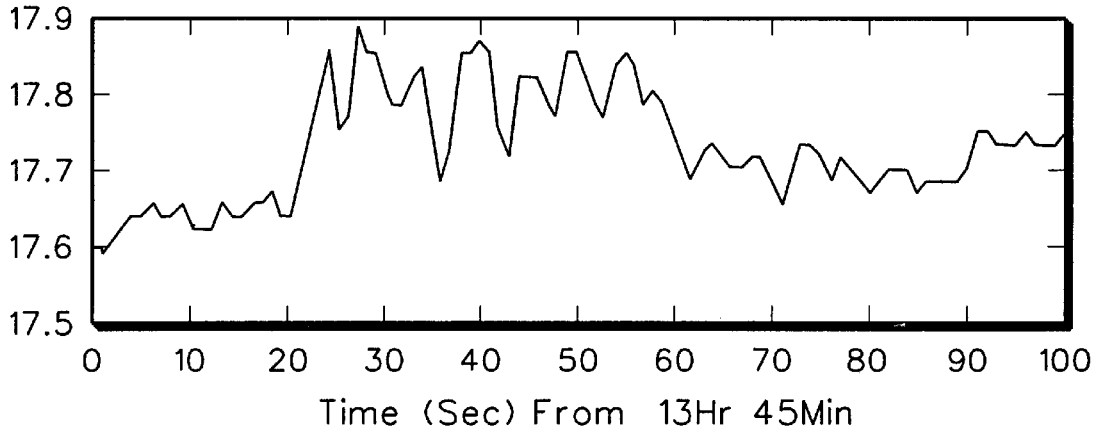
FIG. 2A (PRIOR ART)
FIGS. 2(A and B) are graphs of the skew of the standpipe pressure and the normalized standard deviation of the surface drillstring torque, respectively, during an interval of time of erratic well behavior.
Figure 2B:
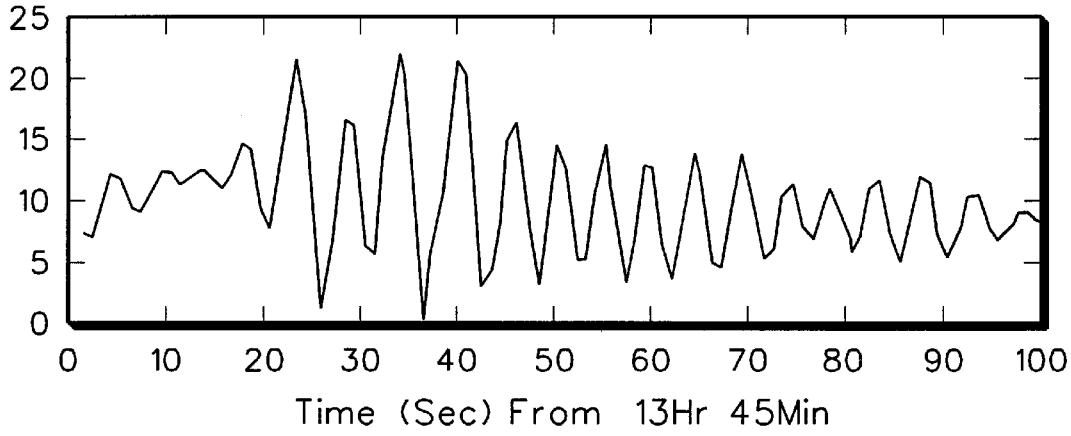
FIG. 2B (PRIOR ART)
Figure 3A:
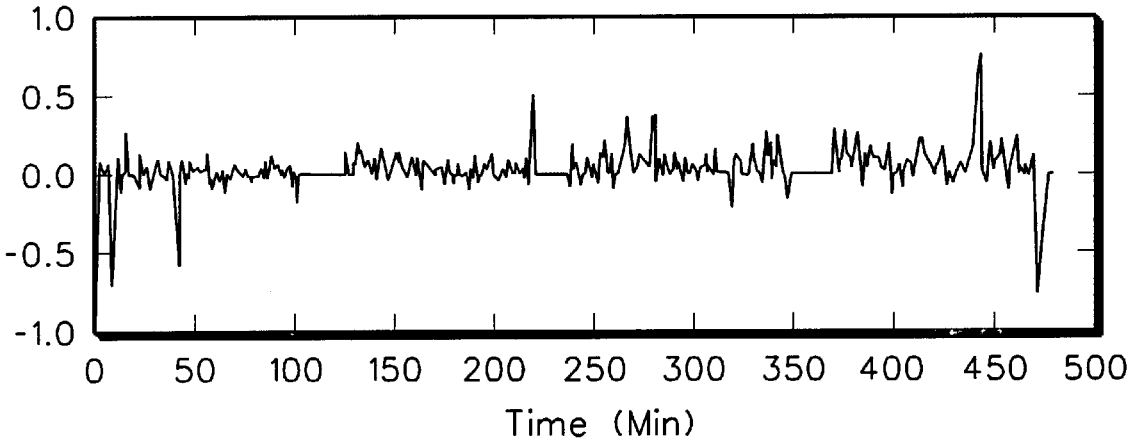
FIG. 3A (PRIOR ART)
FIG. 3(A) is a graph of the product of the skew of the downhole annular fluid pressure trace and the normalized standard deviation of the surface torque trace.
Figure 3B:
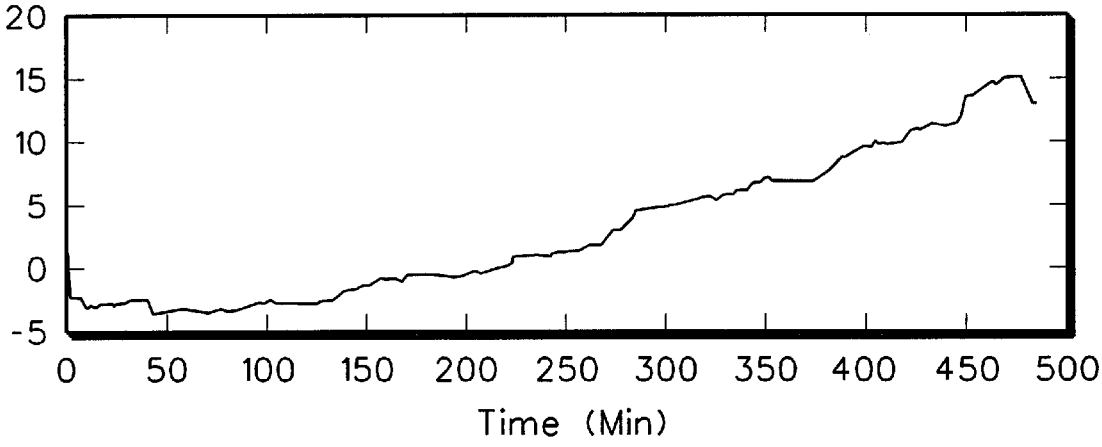
FIG. 3B (PRIOR ART)
FIG. 3(B) is a graph of the integral of the product shown in FIG. 3(A).
Figure 4:
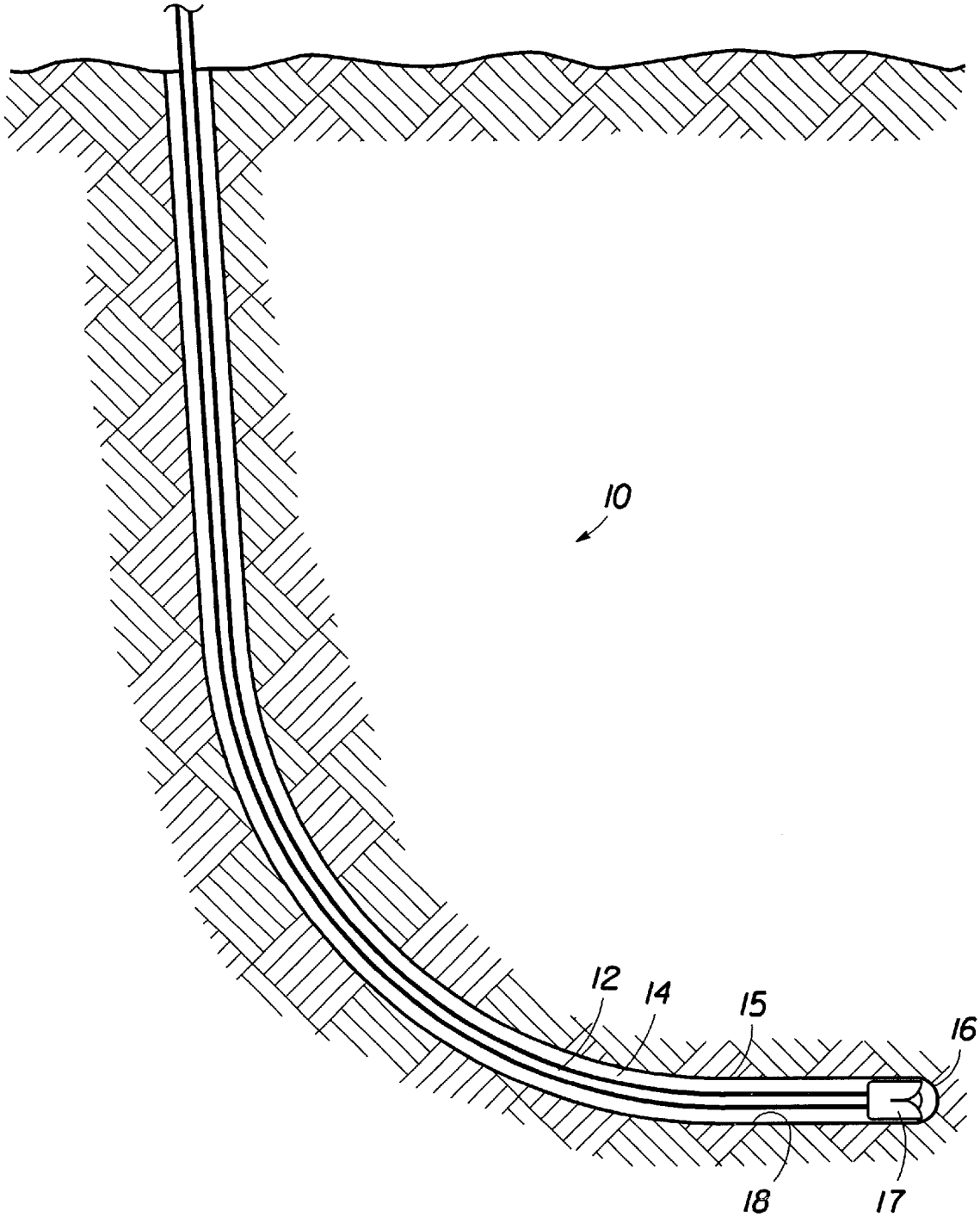
FIG. 4 is a drawing of a wellbore having a horizontal section near its terminus.
Figure 5:
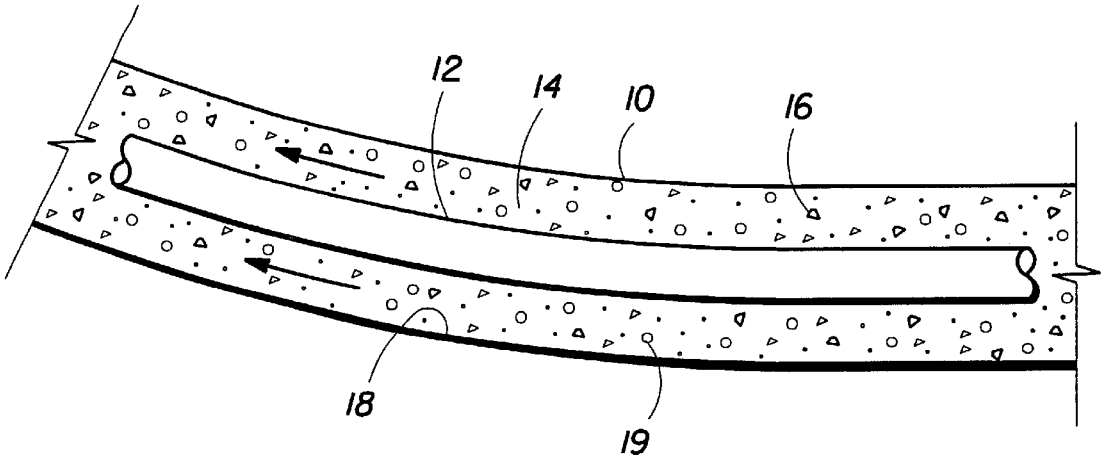
FIG. 5 is a depiction of dispersed and suspended drill cuttings being transported to the surface in drilling mud flowing uphole in the annular flow area formed between the drill string and the side wall of the well.

FIG. 4 is a drawing of a wellbore 10 having a horizontal section 15 near its terminus 16. The slender drillstring 12 is received into the wellbore 10 to turn the drill bit 17 against the bottom of the wellbore 16. The drilling mud is pumped down the interior of the tubular drillstring 12 through the bit 17 and back to the surface in the annulus 14 formed by the exterior of the drillstring 12 and the side wall 18 of the wellbore. FIG. 5 is an enlargement of a portion of the horizontal section 15 of the wellbore 10 and shows drill cuttings 19 being transported by drilling mud flowing in the uphole direction 13 towards the surface.

Figure 6:
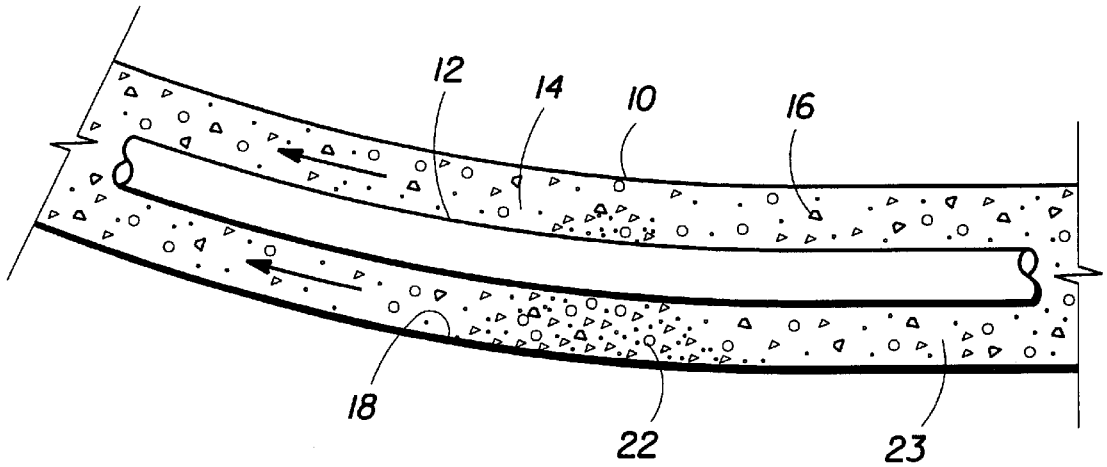
FIG. 6 is depiction of an accumulated bed of settled drill cuttings building from the downward side of a horizontal section of the wellbore.

Like many downhole conditions that occur during rotary drilling, poor hole cleaning and stuck pipe provide a "signature" wellbore response. FIG. 6 depicts drill cuttings settling out of suspension from the drilling mud and accumulating in a bed 22 to form an obstacle to drilling mud flow in the annulus. This "bottleneck" causes all upstream pressures in the circulation loop, from the mud pumps through the standpipe and drill bit to the annulus immediately downhole of the obstruction 23, to increase with diminishing cross sectional area for annular mud flow.

Figure 7:
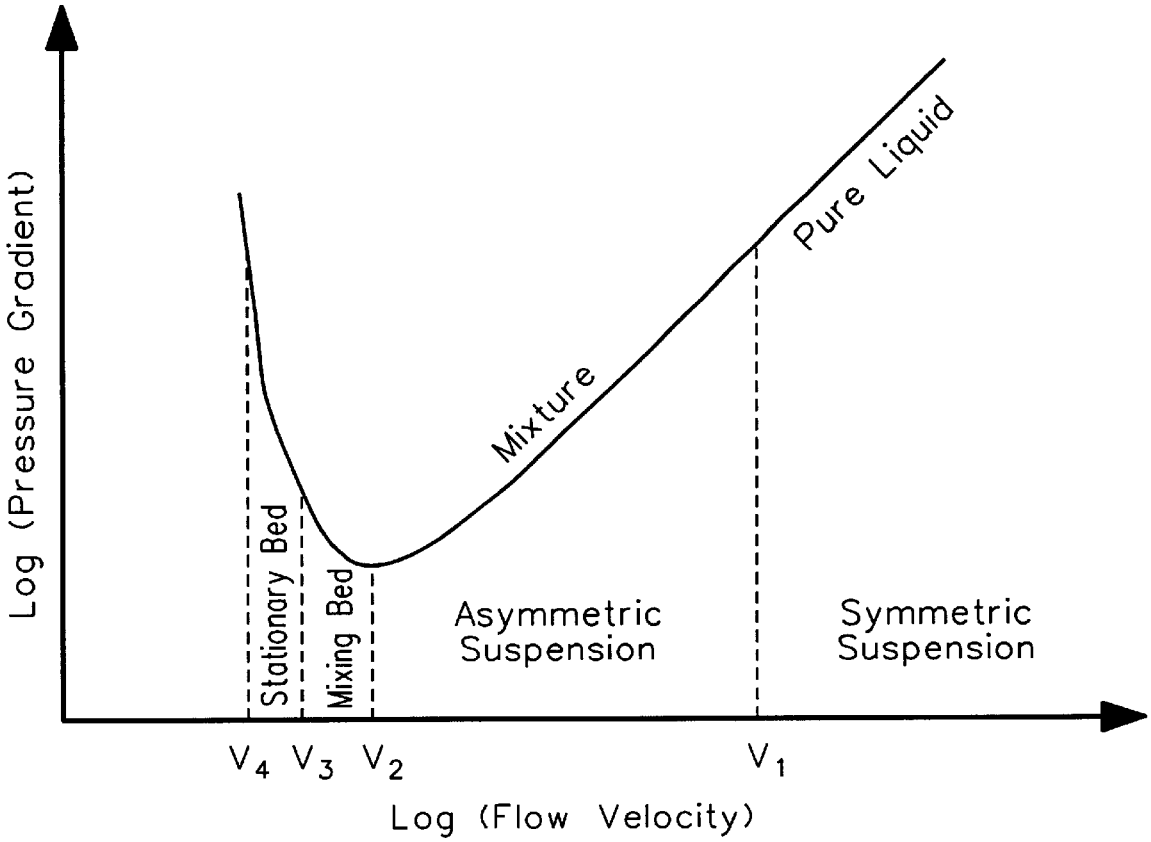
FIG. 7 is a schematic representation of the behavior of an asymmetric suspension of cuttings in drilling mud within a range of pressure gradient and flow velocity.

For a given mud of fixed rheological properties, the pressure gradient and the flow velocity physically determine the capacity of the mud to transport drill cuttings to the surface. The relationship between pressure gradient, mud flow velocity and flow regime of a drilling mud/drill cuttings mixture is shown in FIG. 7. As velocity is decreased, a moving bed of accumulated settled drill cuttings moves uphole along the annulus towards the surface. Further decreases in velocity promotes stationary beds of accumulated drill cuttings in the annulus around the drillstring and resistance to reciprocation and rotation of the drillstring.

Figure 8A:
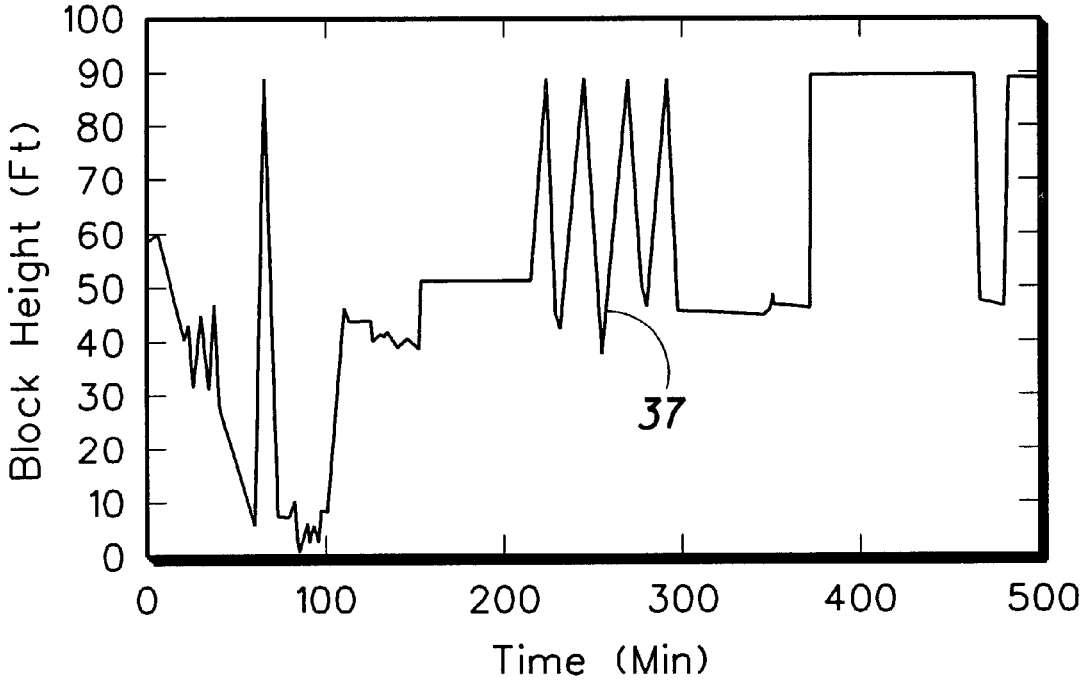
FIG. 8(A) is a graph showing the position of the drilling rig block height and FIG. 8(B) is a graph showing the downhole annular pressure trace (in terms of the equivalent circulating density of drilling mud), both during the same interval of time with of erratic well behavior.
Figure 8B:
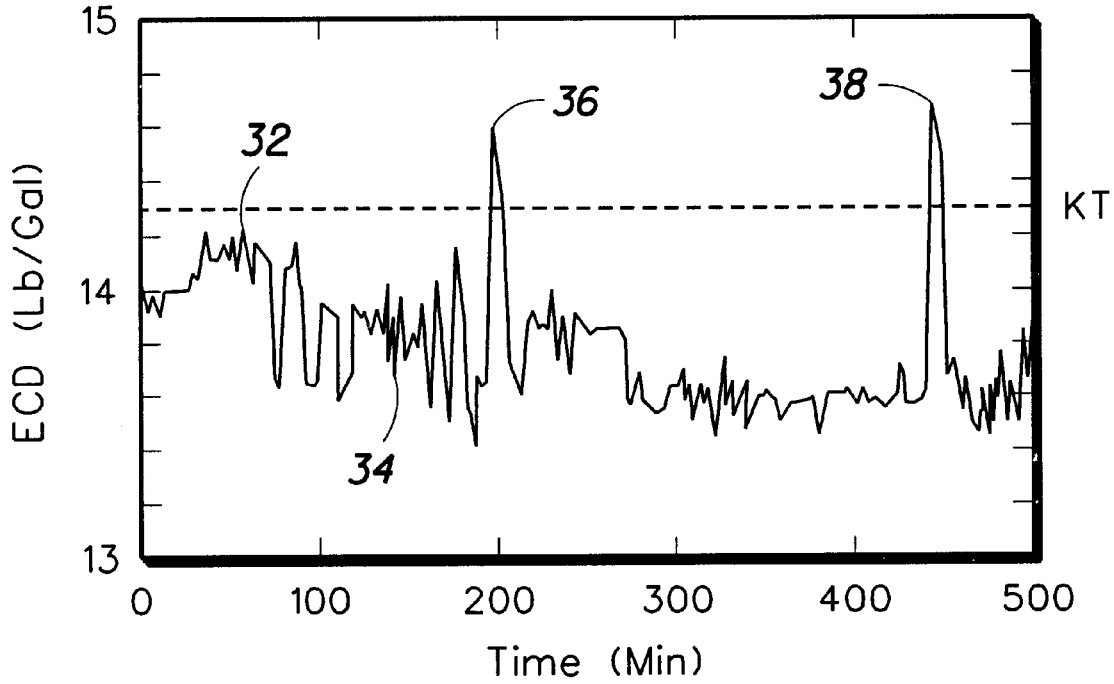

FIG. 8(B) shows one signature response of poor hole cleaning and stuck pipe. The downhole annular fluid pressure measured at the BHA is expressed in FIG. 8(B) in terms of equivalent circulating density (ECD). At the onset of the time interval recorded and depicted in FIG. 8(A), the ECD had been gradually increasing, ultimately peaking at the onset to well instability 32 at 60 minutes. Attempts to reduce the ECD by suspending drilling and circulating drilling mud led to large pressure oscillations 34 from 80 minutes to 200 minutes, then resulting in the first of the two ECD spikes 36 and 38 at 200 and 440 minutes, respectively. These two spikes each reflect obstructed flow in the annulus resulting from accumulated settled drill cuttings. Each spike subsides as increased downhole pressure forcibly displaces, or "blows through," the obstruction and dislodges the accumulated stationary or slow moving bed of drill cuttings.

Drilling progress is usually disrupted as the drilling rig takes remedial actions to address the well instability and hazards indicated by erratic ECD behavior. FIG. 8(A) shows the height of the block supporting the drillstring at all times during the time interval for the ECD plot showing erratic well behavior shown in FIG. 8(B). Drilling progresses smoothly, as indicated by the steadily descending block height, until the onset of well instability 32 at 80 minutes. Drilling progress is suspended during circulation 34, 36 and 38, and reciprocation 37 of the drill string within the wellbore. Suspended drilling operations cause substantial increases in well cost, and each ECD spike 36, 38 brings an increased risk of inadvertent fracturing of exposed formations, drilling mud loss from the well and potential well control problems.

The standpipe pressure (SPP) trace includes information related to the mud pressure throughout the entire circulating system. As such, increases in the SPP may be attributed to poor hole cleaning when in reality such increases could be caused by fluctuations in the pressure drop across the mud motor, back pressure in the MWD tool, blocked nozzles in the drill bit, or other factors upstream from the annulus. Thus, wellbore mechanics unrelated to poor hole cleaning influence the SPP trace, and adversely affects the approximation of downhole annular pressure that's based on SPP. The present invention eliminates these factors and provides a more reliable diagnosis of poor hole cleaning by using real time downhole annular fluid pressure trace measured at or near to the zone of interest and communicated by mud telemetry to the surface. The present invention thereby improves early diagnosis and detection of poor hole cleaning and conditions favorable for the occurrence of stuck pipe.

The present invention eliminates friction losses attributable to physical interference by the side wall, mechanical losses at pipe joint connections and frictional drag on pipe rotation in viscous drilling mud by using real time downhole torque data. Using real time torque data dramatically improves early diagnosis and detection of poor hole cleaning and conditions favorable for the occurrence of stuck pipe.

Figure 9:
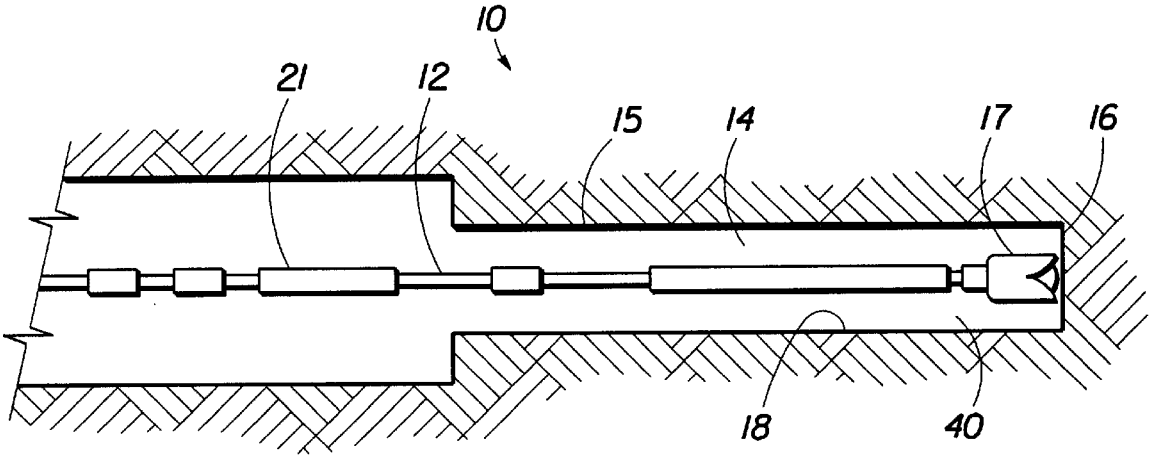
FIG. 9 shows the typical location of the BHA, and the primary downhole annular pressure sensor, in a typical drill string.

Some mud circulation obstructions will not result in corresponding spikes in both the SPP and the normalized standard deviation of the surface torque. FIG. 9 shows that poor hole cleaning or stuck pipe can occur within the sub-BHA depth interval 40 between the BHA 21 and the drill bit 17. In this instance, the signature response 36, 38 of the downhole annular pressure trace will not spike as shown in FIG. 8(B) because the downhole annular pressure being monitored by the BHA 21 is downstream from the flow obstruction in the sub-BHA depth interval 40. The SPP trace would exhibit a surge in response to this type of obstruction that may be correlated under Jardine's method to either the normalized standard deviation of the torque or to the product of the SPP skew and the normalized standard deviation of the torque. Either of these correlations under Jardine's method may provide for early detection of poor hole cleaning or stuck pipe in this sub-BHA depth interval 40. Similarly, an obstruction in the interior of the drill string 12 will result in a surge in SPP without a corresponding increase in either the downhole annular pressure or the torque on the drill string.

While obtaining a reliable mathematical analysis, data that provides advance warning of conditions favorable for the occurrence of stuck pipe is the primary focus of this invention, it is an option, within the scope of the present invention, to automatically initiate remedial measures to alleviate or eliminate the conditions. A closed loop feedback system may be used to automatically decrease weight on bit, increase mud pump flow rate or to circulate a viscous "pill" to better suspend and remove drill cuttings from the wellbore whenever conditions favorable for pipe sticking are detected.

While the foregoing is directed to the preferred embodiment of the present invention, other and further embodiments of the invention may be devised without departing from the basic scope thereof, and the scope thereof is determined by the claims that follow.

We claim:

1. A method of warning of the onset of pipe sticking in a rotary drilling operation using a drill string comprising:

(a) monitoring the downhole annular fluid pressure of drilling mud during a time interval of interest to obtain a series of downhole annular fluid pressure measurements;

(b) monitoring the surface torque required to rotate the drill string during the time interval of interest to obtain a series of torque measurements corresponding to the series of downhole annular fluid pressure measurements;

(c) comparing the series of downhole annular fluid pressure measurements with the series of torque measurements so as to identify corresponding changes in both; and (d) raising an alarm as to the onset of pipe sticking when the magnitude of the identified corresponding changes exceeds predetermined values.

2. A method of warning of the onset of pipe sticking in a rotary drilling operation using a drill string comprising:

(a) monitoring the downhole annular fluid pressure of drilling mud during a time interval of interest to obtain a series of downhole annular fluid pressure measurements;

(b) monitoring the downhole torque applied to the drill string at a depth interval of interest during the time interval of interest to obtain a series of torque measurements corresponding to the series of downhole annular fluid pressure measurements;

(c) comparing the series of downhole annular fluid pressure measurements with the series of torque measurements so as to identify corresponding changes in both; and (d) taking remedial measures to prevent pipe sticking when the magnitude of the identified corresponding changes exceeds predetermined values.

3. A method of warning of the onset of pipe sticking in a rotary drilling operation using a drill string comprising:

(a) monitoring the downhole annular fluid pressure of drilling mud in the depth interval of interest over a predetermined period of time to obtain a series of downhole annular fluid pressure measurements;

(b) monitoring the surface torque required to rotate the drill string during the predetermined periods of time to obtain a series of torque measurements corresponding to the series of downhole annular fluid pressure measurements;

(c) determining the skew (third moment) of each series of downhole annular fluid pressure measurements according to the relationship $$\text{skew}=(1/N)\Sigma[(x_i-x_{mean})/\sigma]^3,$$

wherein N is the number of downhole annular fluid pressure measurements $x_i$ in the series, $x_{mean}$ is the average value of the measurements in the series, and $\sigma$ is the standard deviation of the measurements in the series;

(d) determining the normalized standard deviation $\sigma_n$ of the surface torque measurements in each corresponding series of surface torque measurements according to the relationship $$\sigma_n=(\sigma/y_{mean}),$$

wherein $\sigma$ is the standard deviation of the measurements in the series and $y_{mean}$ is the average value of the measurements in the series;

(e) comparing skew and $\sigma_n$ for the series so as to identify corresponding changes in both; and (f) raising an alarm when the magnitude of changes in the product exceeds predetermined alarm values.

4. The method of claim 3 wherein the step of comparing the skew and $\sigma_n$ for the series comprises:

(a) obtaining the product of the skew and $\sigma_n$ and (b) monitoring the product and raising the alarm when the value of the product exceeds an alarm value.

5. The method of claim 4 wherein the product of skew and $\sigma_n$ is integrated over the period of time and the integrated value is updated on a regular basis.

6. The method of claim 5 wherein the current value of the integral is used to trigger the alarm.

7. The method of claim 6 wherein the integration period is about 1 to 2 hours and the integrated value is updated at a period of about one minute.

8. The method of claim 6 wherein the predetermined period of time is of the order of 120 seconds and calculations are repeated every 60 seconds.

9. The method of claim 7 wherein the predetermined period of time is of the order of 120 seconds and calculations are repeated every 60 seconds.

10. The method of claim 5 wherein the integration period is around 1–2 hours and the integrated value is updated at period of about one minute.

11. The method of claim 10 wherein the predetermined period of time is of the order of 120 seconds and calculations are repeated every 60 seconds.

12. The method of claim 5 wherein the predetermined period of time is of the order of 120 seconds and calculations are repeated every 60 seconds.

13. The method of claim 4 wherein the predetermined period of time is of the order of 120 seconds and calculations are repeated every 60 seconds.

14. The method of claim 3 wherein the predetermined period of time is of the order of 120 seconds and calculations are repeated every 60 seconds.

15. A method of warning of the onset of pipe sticking in a rotary drilling operation using a drill string comprising:

(a) monitoring the downhole annular fluid pressure of drilling mud in the interval of interest over predetermined periods of time to obtain a series of downhole annular fluid pressure measurements;

(b) monitoring the downhole torque on the drill string during the predetermined periods of time to obtain a series of downhole torque measurements corresponding to the series of downhole annular fluid pressure measurements;

(c) determining the skew (third moment) of each series of downhole annular fluid pressure measurements according to the relationship $$\text{skew}=(1/N)\Sigma[(x_i-x_{mean})/\sigma]^3,$$

wherein N is the number of downhole annular fluid pressure measurements $x_i$ in the series, $x_{mean}$ is the average value of the measurements in the series, and $\sigma$ is the standard deviation of the measurements in the series;

(d) determining the normalized standard deviation $\sigma_n$ of the downhole torque measurements in each corresponding series of surface torque measurements according to the relationship $$\sigma_n=(\sigma/y_{mean}),$$

wherein $\sigma$ is the standard deviation of the measurements in the series and $y_{mean}$ is the average value of the measurements in the series;

(e) comparing skew and a $\sigma_n$ for the series so as to identify corresponding changes in both; and (f) raising an alarm when the magnitude of changes in the product of the skew and the normalized standard deviation of the surface torque measurement exceeds predetermined alarm values.

16. A method of warning of the onset of pipe sticking in a rotary drilling operation using a drill string comprising:

(a) monitoring two or more downhole annular fluid pressures of drilling mud in two or more intervals of interest over predetermined periods of time to obtain two series of downhole annular fluid pressure measurements;

(b) monitoring the surface torque required to rotate the drill string during the predetermined periods of time to obtain a series of torque measurements corresponding to the series of downhole annular fluid pressure measurements;

(c) determining the skews (third moments) of each of the series of downhole annular fluid pressure measurements according to the relationship $$\text{skew}=(1/N)\Sigma[(x_i-x_{mean})/\sigma]^3,$$

wherein N is the number of downhole annular fluid pressure measurements $x_i$ in a series, $x_{mean}$ is the average value of the measurements in the series, and $\sigma$ is the standard deviation of the measurements in the series;

(d) determining the normalized standard deviation $\sigma_n$ of the surface torque measurements in each corresponding series of surface torque measurements according to the relationship $$\sigma_n=(\sigma/y_{mean}),$$

wherein $\sigma$ is the standard deviation of the measurements in the series and $y_{mean}$ is the average value of the measurements in the series;

(e) comparing skews and $\sigma_n$ for the series so as to identify corresponding changes; and (f) comparing skews and $\sigma_n$ for the series so as to locate depth intervals in which the identified corresponding changes occur; and (g) raising an alarm when the magnitude of changes in the product of a skew and the normalized standard deviation of the surface torque measurement exceeds predetermined alarm values.

17. A method of warning of the onset of pipe sticking in a rotary drilling operation using a drillstring comprising:

(a) monitoring the downhole annular fluid pressure of drilling mud in the interval of interest over predetermined periods of time to obtain a series of downhole annular fluid pressure measurements;

(b) monitoring downhole torque at two or more locations on the drill string during the predetermined periods of time to obtain two or more series of downhole torque measurements corresponding to the series of downhole annular fluid pressure measurements;

(c) determining the skew (third moment) of each series of downhole annular fluid pressure measurements according to the relationship $$\text{skew}=(1/N)\Sigma[(x_i-x_{mean})/\sigma]^3,$$

wherein N is the number of downhole annular fluid pressure measurements $x_i$ in the series, $x_{mean}$ is the average value of the measurements in the series, and $\sigma$ is the standard deviation of the measurements in the series;

(d) determining the normalized standard deviation $\sigma_n$ of each series of downhole torque measurements in each corresponding series of downhole torque measurements according to the relationship $$\sigma_n=(\sigma/y_{mean}),$$

wherein $\sigma_1$ is the standard deviation of the measurements in the series and $y_{mean}$ is the average value of the measurements in the series;

(e) comparing skew and $\sigma_n$ for the series so as to identify corresponding changes in both; and (f) raising an alarm when the magnitude of changes in the product of the skew and the normalized standard deviation of the torque measurement exceeds predetermined alarm values.

* * * * *